US006302341B1

(12) United States Patent
Yoo

(10) Patent No.: US 6,302,341 B1
(45) Date of Patent: Oct. 16, 2001

(54) INJECTOR FOR SUPPLYING FUEL

(75) Inventor: Jae Woong Yoo, Suwon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/563,112

(22) Filed: May 2, 2000

(30) Foreign Application Priority Data

Sep. 18, 1999 (KR) ..... 99-040267

(51) Int. Cl.[7] ..... B05B 1/30; F02M 51/00

(52) U.S. Cl. ..... 239/585.1; 239/585.5; 239/574; 251/129.09; 335/268; 137/613

(58) Field of Search ..... 239/574, 584, 239/585.1, 585.4, 585.5; 251/129.1, 129.09, 129.21; 335/266, 268, 259; 137/613, 614.19, 614.21

(56) References Cited

U.S. PATENT DOCUMENTS

| | | | | |
|---|---|---|---|---|
| 3,462,116 | * | 8/1969 | Wright, Jr. | 251/129.09 X |
| 3,942,485 | * | 3/1976 | Suda et al. | 251/129.21 |
| 4,925,112 | | 5/1990 | Wahba | 239/585 |
| 4,972,996 | * | 11/1990 | Cerny | 239/585.1 |
| 5,199,459 | * | 4/1993 | Mullally | 251/613 |
| 5,450,876 | * | 9/1995 | Reinicke | 251/129.21 |
| 5,979,786 | | 11/1999 | Longman et al. | 239/5 |
| 6,113,014 | * | 9/2000 | Coldren et al. | 239/585.1 |

* cited by examiner

*Primary Examiner*—David A. Scherbel
*Assistant Examiner*—Steven J. Ganey
(74) *Attorney, Agent, or Firm*—Christie, Parker & Hale, LLP

(57) ABSTRACT

An injector for supplying fuel into the combustion chamber of an internal combustion engine comprising an injector body having a fuel supplying port connected to a fuel rail, a nozzle port injecting the fuel and a fuel passage connecting the fuel supplying port and the nozzle port; two solenoids are mounted in the injector body along the fuel passage; and two spools elastically supported by two springs are mounted in each of the solenoid 10, 20 respectively and opens or closes selectively the fuel supplying port 110 and the nozzle port 120; wherein, when the fuel is supplied from the fuel rail into the injection body, one spool for supplying the fuel opens the fuel supplying port and the other spool for injecting the fuel closes the nozzle port, whereas when the fuel is injected into the combustion chamber, the spool for supplying the fuel closes the fuel supplying port and the other spool for injecting the fuel opens the nozzle port.

4 Claims, 3 Drawing Sheets

Fig.. 1
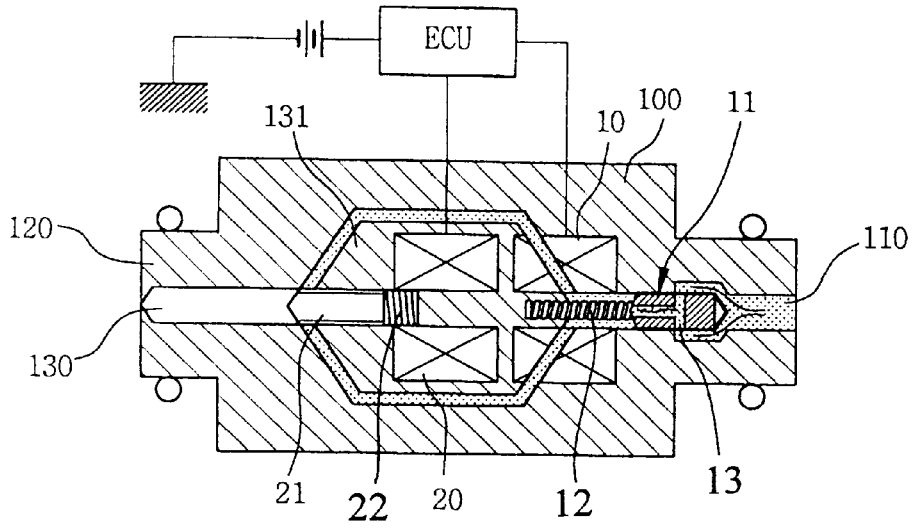
Fig.. 2
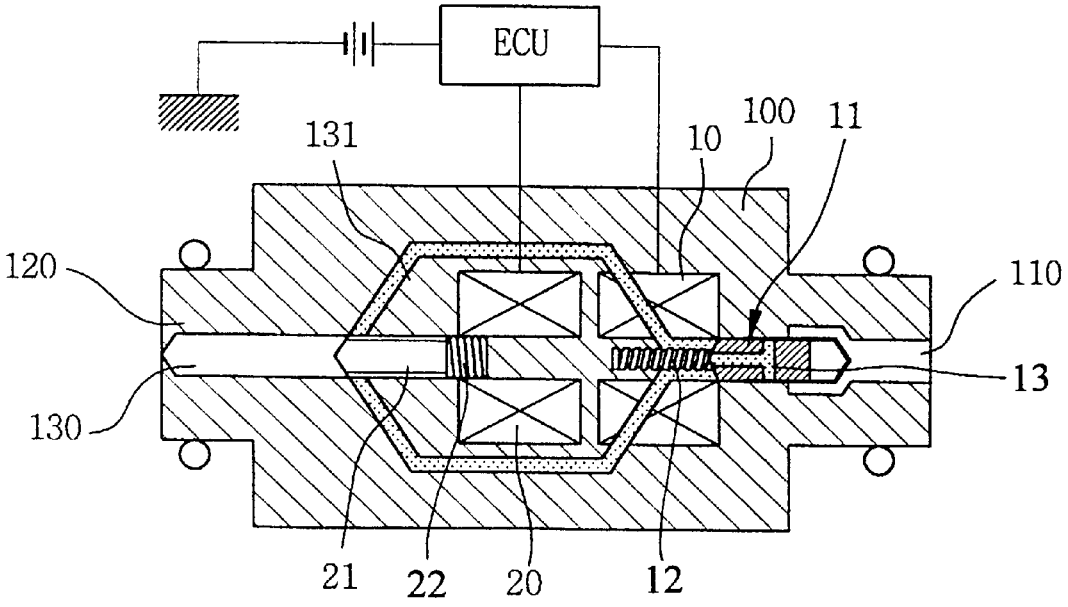

Fig.. 3
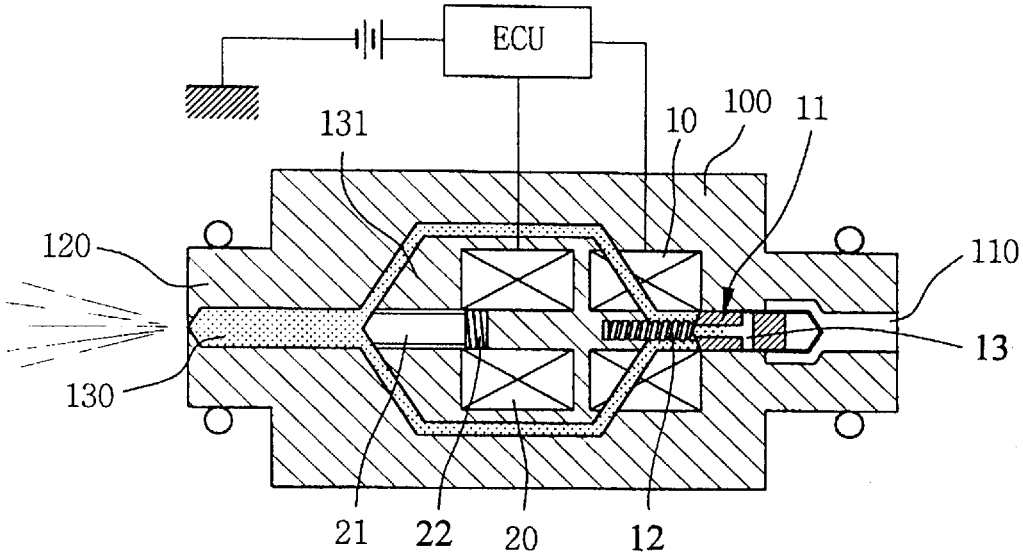
Fig.. 4
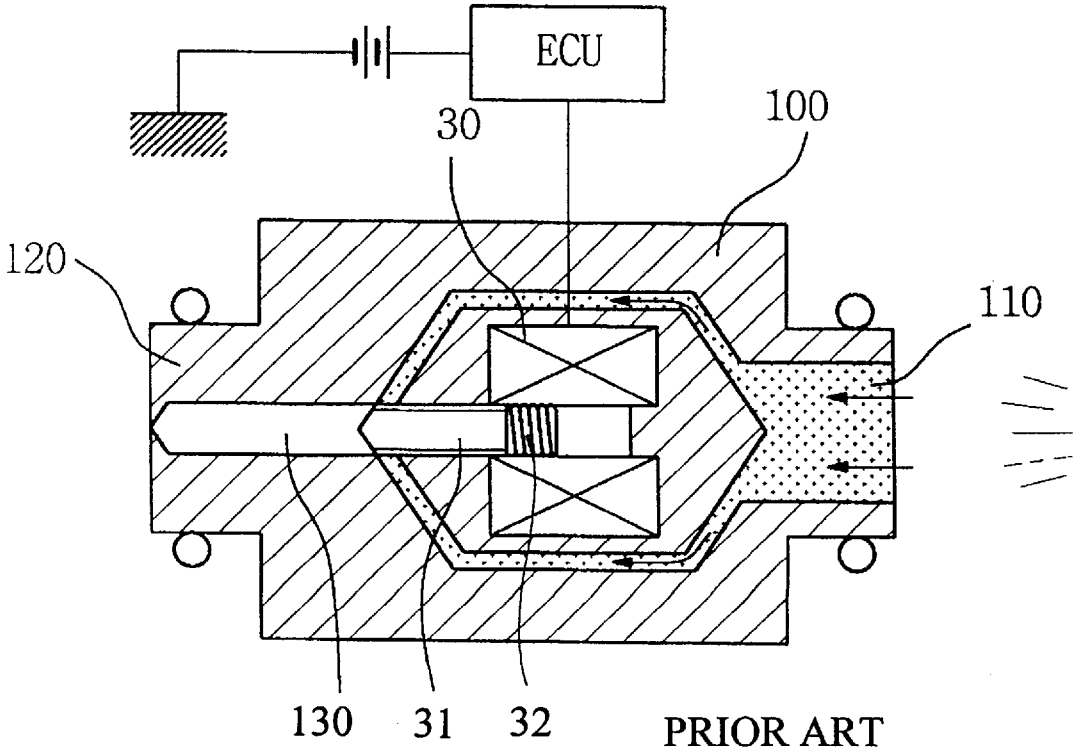
PRIOR ART

Fig.. 5
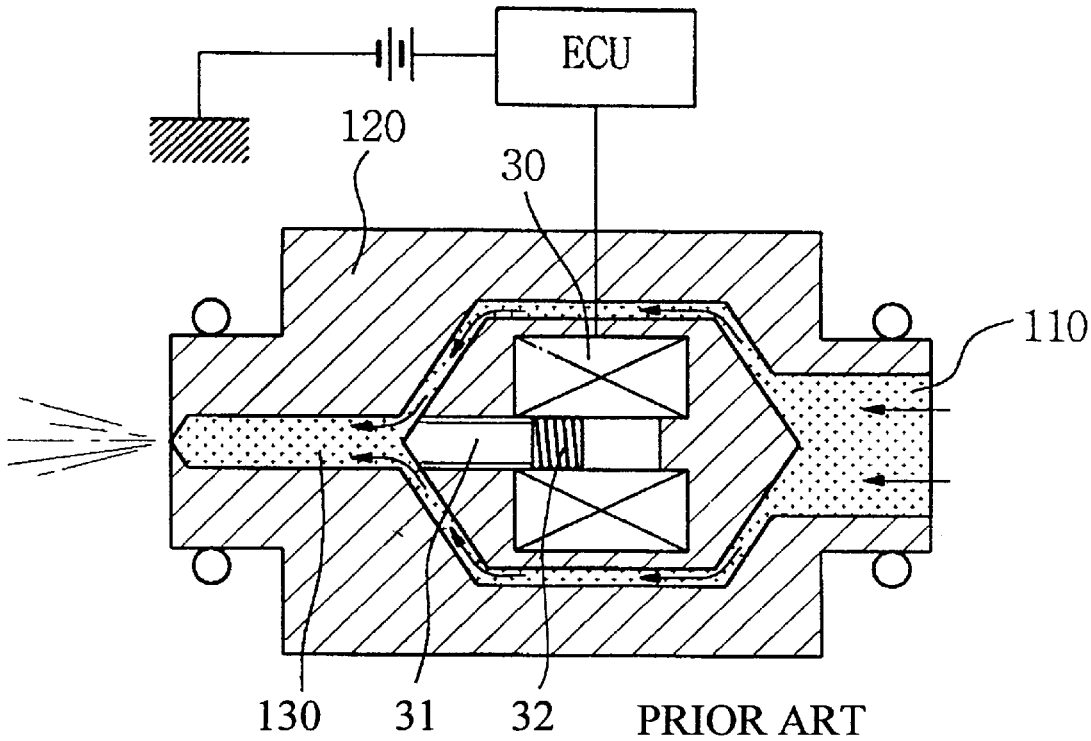
Fig.. 6
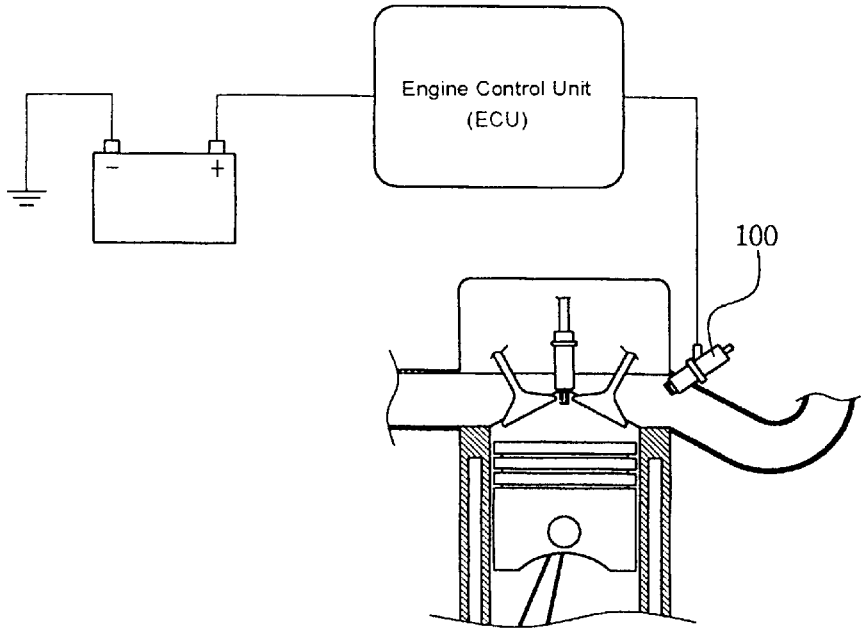

INJECTOR FOR SUPPLYING FUEL

FIELD OF THE INVENTION

The present invention relates to an injector for supplying fuel into an internal combustion engine, particularly a fuel injector having two solenoids for controlling the flow of the fuel in the fuel injector, which is capable of preventing the surge pressure of fuel without the return of the fuel to a fuel tank.

BACKGROUND OF THE INVENTION

Generally, in a fuel supplying device to the internal combustion engine, there are two types of fuel supplying methods, one of which has return pipe for returning the fuel remained in the fuel supplying device after injection of the fuel to a combustion chamber of the engine, the other of which has not the return pipe for returning the fuel remained in the supplying fuel device.

Especially, the returnless type of fuel supplying method supplies the fuel supplied from a fuel pump by operation of the fuel pump to a fuel rail after the pressure of the fuel is constantly regulated by a fuel regulator. Then the fuel of the fuel rail is injected to the combustion chamber of the internal combustion engine through a fuel injector.

As shown in FIG. 4 and FIG. 5, the typical structure of the fuel injector comprises a body 100 having a supplying port 110 through which the fuel having constant pressure is supplied into the body 100 and a nozzle port 120 through which the fuel is injected into the combustion chamber of the internal combustion engine.

In the body 100 of the fuel injector is mounted a spool 31, which is moved by operation of a solenoid 30 and supported by a spring 32 to selectively opens and closes the fuel passage 130 formed in the body 100.

The fuel is supplied into the body 100 of the fuel injector under the state that the spool 21 closes the fuel passage 130. Then, at injection time, the spool 31 is moved to the inside of the solenoid 30 to open the fuel passage 130 and the fuel in the fuel passage 130 is injected through the end of left part of the nozzle port 120.

As shown in FIG. 5, the prior fuel injector opens the fuel passage 130 under the state that the supplying port 110 is opened even the injection time, so the fuel pressure in the fuel rail is instantly varied. As the result of that, the fuel amount injected into the combustion chamber of the internal combustion engine is reduced, and then the engine is hunted and the output of the engine is decreased.

While, in U.S. Pat. No 4,925,112 is disclosed a fuel injector, which has a pair solenoid coils aligned along a common axis between an armature that serve as fuel metering valve and an armature that operates a charge delivery valve.

And in U.S. Pat. No 5.979.786 is disclosed a fuel injection apparatus, which has a single solenoid coil that controls the movement of a first and second armature respectively. Each armature is connected to a valve element for controlling a fuel supply and for controlling the delivery of the charge respectively.

Then, the fuel injectors according to the above U.S. Patents are to control the flow of the fuel and the air simultaneously. Therefore, the construction of the fuel injector is very complex and have too much number of parts in their inside.

SUMMARY OF THE INVENTION

The object of the present invention is to provide a fuel injector that is capable of preventing the surge pressure of fuel without the return of the fuel to a fuel tank.

The other object of the present invention is to provide a fuel injector of which construction is simple and is comprised of few numbers of parts.

The present invention to achieve the above object comprises an injector for supplying fuel into the combustion chamber of an internal combustion engine comprising an injector body having a fuel supplying port connected to a fuel rail, a nozzle port injecting the fuel and a fuel passage connecting the fuel supplying port and the nozzle port; two solenoids are mounted in the injector body along the fuel passage; and two spools elastically supported by two springs are mounted in each of the solenoid 10 and 20 respectively and opens or closes selectively the fuel supplying port 110 and the nozzle port 120.

Wherein, when the fuel is supplied from the fuel rail into the injection body, one spool for supplying the fuel opens the fuel supplying port and the other spool for injecting the fuel closes the nozzle port, whereas when the fuel is injected into the combustion chamber, the spool for supplying the fuel closes the fuel supplying port and the other spool for injecting the fuel opens the nozzle port.

The fuel injector in accordance with the present invention can control the fuel supplied into the combustion chamber of the internal combustion engine without the surge pressure, when the fuel is injected Moreover, since the fuel injector in accordance with the present invention is comprised of two solenoids and two spools that are arranged along the fuel passage, the structure is simple and the fuel injector have few number of parts. Therefore, the fuel injector can be easily repaired and assembled in the manufacturing part.

BRIEF DESCRIPTION OF THE DRAWINGS

The above object and other advantages of the present invention will become more apparent by describing in detail the preferred embodiment of the present invention with reference to the attached drawings in which:

FIG. 1 is a section view of the fuel injector in accordance with the present invention in the state that the nozzle port is closed by a nozzle spool and the fuel supplying port is opened, FIG. 2 is a section view of the fuel injector in accordance with the present invention in the state that the nozzle port is closed by a nozzle spool and the fuel supplying port is closed, FIG. 3 is a section view of the fuel injector in accordance with the present invention in the state that the nozzle port is open and the fuel supplying port is closed by the nozzle spool and the fuel spool respectively, FIG. 4 is a section view of the fuel injector in accordance with the prior art in the state that the nozzle port is closed by the nozzle spool, FIG. 5 is a section view of the fuel injector in accordance with the prior art in the state that the nozzle port is opened by the nozzle spool.

FIG. 6 is schematic figure of fuel injector mounted on engine in general.

DETAILED DESCRIPTION OF THE PRESENT INVENTION

A fuel injector in accordance with the present invention comprises an injector body 100 having a fuel supplying port 110 connected to a fuel rail (not shown) and a nozzle port 120 injecting a fuel. Two solenoids 10 and 20 are mounted in the injector body 100, and two spools 11 and 21 elastically supported by spring 12 and 22 are mounted in each of the solenoid 10 and 20 respectively and selectively opens and closes the fuel supplying port 110 and the nozzle port 120.

The injector body 100 has a fuel passage 130 that connects the fuel supplying port 110 with the nozzle port 120, and the fuel passage 130 has an enlarged hole in the middle portion thereof.

A stator 131 is fixed to the injector body 100 in the middle portion of the fuel passage 130 and the fuel is passed through the fuel passage between the stator 131 and the injector body 100. The first solenoid 20 matched with the spool 21 is mounted in the stator 131.

The nozzle spool 21 is biased and normally closes the nozzle port 120 by the elastic force of the spring 22. Then when the first solenoid 20 is energized, the nozzle spool 21 is moved to the inside of the stator 131 and opens the nozzle port 120.

That is, when the first solenoid 20 is de-energized, the spool 21 is biased by the elastic force of the spring 22 and closes the nozzle port 120. Whereas the first solenoid 20 is energized, the spool 21 is moved to the inside of the stator 131 against the elastic force of the spring 22 and opens the nozzle port 120.

The second solenoid 10 is mounted on the rear end of the stator 131, and matched with the spool 11.

The fuel supplying spool 11 is made by the method commonly used in the related technical part and has a fuel passage 13 that is selectively closed and opened by the movement along the fuel supplying port 110.

As shown in FIGS. 1 through 3, the fuel passage 13 of the spool 11 has T shape and the one end of the fuel passage 13 is protruded outside of the spool 11. Then, when the second solenoid 10 is de-energized, the entrance of the fuel passage 13 is exposed to the fuel supplying port 110 and the fuel passage 13 is opened. Whereas the second solenoid 10 is energized, the spool 11 is moved inside of the solenoid 10 against the elastic force of the spring 12 and the fuel passage 13 is closed.

Now, the operation of the fuel injector in accordance with the present invention will be described in detail.

As shown in FIG. 1, at the initial state, both of the first solenoid 20 and the second solenoid 10 are de-energized, and the spool 21 is biased by the elastic force of the spring 22 and closes the nozzle port 120 and the spool 11 is biased by the elastic force of the spring 12 and opens the fuel supplying port 110.

At this state, the fuel is supplied from the fuel rail through the fuel supplying port 110 into injector body 100.

When the injector body 100 is completely filled with the fuel, the second solenoid 10 is energized and the spool 11 is moved to the inside of the solenoid 10. Then the fuel passage 13 of the spool 11 is closed and the supplying of the fuel is stopped, as shown in FIG. 2.

That is, when the body of the injector body 100 is completely filled with the fuel having constant pressure fuel, the second solenoid 10 is energized and the spool 11 is moved to the inside of the injection body 100. Then the fuel passage 13 of the spool 11 is closed and the supplying of the fuel is stopped.

This step is the state that the fuel in the injection body 100 is ready to be injected.

Next, when the fuel injection time is started, as shown in FIG. 2, the first solenoid 20 is energized under the state that the second solenoid 10 is energized and the fuel passage 13 of the spool 11 is closed. Then the spool 21 is moved into the first solenoid 20 and the nozzle port 120 is opened. And the fuel in the injection body 100 is injected into the combustion chamber of the internal combustion engine through the nozzle port 120.

After the fuel in the injection body 100 is completely injected, the first solenoid 20 and the second solenoid 10 are returned to the original state that both the solenoids 10 and 20 are de-energized. And the fuel supplying port 110 is opened and the nozzle port 120 is closed. The each step described above is continuously repeated to supply the fuel into the combustion chamber.

The two solenoids are controlled by an electronic control mechanism (not shown) according to the method of the present invention and the electronic control mechanism is connected with the control part of the automobile. And the electric control mechanism controls the fuel injector in accordance with the present invention according to the operation state of the engine.

As describe above, since the fuel injector in accordance with the present invention is comprised of two solenoids 10, 20 and two spools 11, 21 that are arranged along the fuel passage 130, the structure is simple and the fuel injector have a few numbers of parts. Therefore, the fuel injector can be easily repaired and assembled in the manufacturing part.

Moreover, the fuel injector in accordance with the present invention can prevent the surge pressure of the fuel supplied into the internal combustion engine, because the fuel in the injection body is injected under the state that the fuel supplying port is closed and the pressure of the fuel in the injection body is not varied, when the fuel in the injection body is injected.

What is claimed is:

1. An injector for supplying fuel into the combustion chamber of an internal combustion engine comprising:

an injector body having a fuel supplying port adapted to be connected to a fuel rail, a nozzle port injecting the fuel, and a fuel passage connecting the fuel supplying port and the nozzle port;

two solenoids mounted in the injector body along the fuel passage; and two spools elastically supported by two springs mounted in each of above solenoids respectively and opens or closes selectively the fuel supplying port and the nozzle port;

wherein, when the fuel is adapted to be supplied from the fuel rail into the injector body, one spool for supplying the fuel opens the fuel supplying port and the other spool for injecting the fuel closes the nozzle port, whereas when the fuel is adapted to be injected into the combustion chamber, the spool for supplying the fuel closes the fuel supplying port and the other spool for injecting the fuel opens the nozzle port.

2. An injector for supplying the fuel into the combustion chamber of the internal combustion engine according to claim 1, wherein when the fuel supplying solenoid is energized, the spool for supplying the fuel is closed.

3. An injector for supplying the fuel into the combustion chamber of the internal combustion engine according to claim 1, wherein when the nozzle solenoid is energized, the spool for injecting the fuel is opened.

4. An injector for supplying the fuel into the combustion chamber of the internal combustion engine according to claim 1, wherein the fuel passage of the spool adapted to be connected to said fuel rail has a T shape.

* * * * *